US005987701A

United States Patent [19]

Kuo

[11] Patent Number: 5,987,701

[45] Date of Patent: Nov. 23, 1999

[54] POP-UP MECHANISM FOR AN EXTENDABLE HANDLE ON A WHEELED LUGGAGE CASE

[75] Inventor: Chung Hsien Kuo, Taipei, Taiwan

[73] Assignee: Chaw Khong Technology Co. Ltd., Taipei County, Taiwan

[21] Appl. No.: 09/088,815

[22] Filed: Jun. 2, 1998

[51] Int. Cl.[6] ..... A47B 95/02

[52] U.S. Cl. ..... 16/113.1; 190/115; 280/37; 280/655; 280/655.1; 280/47.24; 280/47.26

[58] Field of Search ..... 16/115; 190/39, 190/115, 18 A, 15 R, 104, 14; 280/37, 651, 652, 655, 655.1, 47.18, 47.24, 47.26

[56] References Cited

U.S. PATENT DOCUMENTS

| | | | |
|---|---|---|---|
| 5,526,908 | 6/1996 | Wang | 190/115 |
| 5,639,109 | 6/1997 | Liang | 280/655.1 |
| 5,803,214 | 9/1998 | Wang | 190/115 |

*Primary Examiner*—Chuck Y. Mah

*Attorney, Agent, or Firm*—Tung & Associates

[57] ABSTRACT

A pop-up mechanism is provided for use on the extendable handle of a wheeled luggage case to allow the extendable handle to be extended out in a pop-up manner that allows the user to easily grip the handle to pull the luggage case on the ground. The pop-up mechanism is simple in construction than those in the prior art so that the manufacture and maintenance can be easily carried out. The pop-up mechanism of the invention includes a fastening device mounting on one of the tubes and an elastic driving device secured to the fastening device. The elastic driving device is formed with a cavity in which an elastic means and a slidable block seated on the elastic means are mounted. The slidable block is slidingly movable in the cavity. When the extendable handle is in a retracted position, the slidable block is urged to compress the elastic means and thus being moved downwardly to a lowest position; and when unlocked, the compressed elastic means is expanded to cause the slidable block and the elongated bars of the extendable handle to be popped up. By utilizing this pop-up mechanism, the assembly and disassembly of the component parts of the pop-up mechanism are easy to carry out, resulting in a reduction in the manufacturing and maintenance costs.

6 Claims, 4 Drawing Sheets

POP-UP MECHANISM FOR AN EXTENDABLE HANDLE ON A WHEELED LUGGAGE CASE

BACKGROUND OF THE INVENTION

1. Field of the Invention

This invention relates to a pop-up mechanisms, and more particularly, to a pop-up mechanism for use on an extendable handle of a wheeled luggage case, which allows the extendable handle to be extended out in a pop-up manner, and allows the user to easily and conveniently use the extended handle to pull the wheeled luggage case on the ground.

2. Description of Related Art

A wheeled luggage case is widely used by travelers at airports to carry personal belongings, which is equipped with wheels and an extendable handle that allows the user to easily and effortlessly carry the luggage case by pulling it on the ground. The extendable handle is normally retracted and locked in the luggage case and can be unlocked to be extended out for the user to pull the wheeled luggage case on the ground.

In most wheeled luggage cases, the extendable handle is usually provided with a pop-up mechanism that allows the handle to be extended out in a pop-up manner when a button is pressed so that the user can use the handle fast and conveniently.

Such pop-up mechanisms are, for example, disclosed in Kazmark, Jr. et al., U.S. Pat. No. 5,522,615, a Cart and Luggage Handle Assembly with an Actuator and Release Apparatus; Chen, U.S. Pat. No. 5,530,990, a Handle Assembly for Suitcase; Lu, U.S. Pat. No. 5,584,097, a Full Handle for a Truck; Liang, U.S. Pat. No. 5,639,109, a Collapsible Luggage Trolley, to name a few. These pop-up mechanisms, however, are quite complex in construction such that disassembly of the component parts for maintenance and repair would be difficult and thus it is laborious and time-consuming to carry out. Moreover, since the spring used for the pop-up action will be compressed for each use, it can suffer from elastic fatigue after long time of use and should therefore be replaced frequently. However, since these conventional pop-up mechanisms are quite complex in construction, the replacement of the spring will then involve a laborious work. Both assembly and disassembly are thus laborious and time-consuming to carry out. Therefore, the use of these conventional pop-up mechanisms would involve high the manufacturing and maintenance costs.

SUMMARY OF THE INVENTION

It is therefore an objective of the present invention to provide a pop-up mechanism for an extendable handle of a wheeled luggage case, which is simpler in construction than those in the prior art so that the manufacture and maintenance for the pop-up mechanism can be easily carried out and the costs thereof can thus be reduced.

In accordance with the foregoing and other objectives of the present invention, a novel pop-up mechanism for an extendable handle of a wheeled luggage case is provided. The pop-up mechanism is provided for use on an extendable handle on a wheeled luggage case for the purpose of locking the extendable handle at a retracted position and allowing a user to extend the extendable handle from the retracted and locked position in a pop-up manner, the extendable handle including a pair of parallelly elongated bars which are extendable from and retracted into a pair of tubes on the luggage case. The pop-up mechanism of the invention includes the following component parts:

a bezel body having a button; a pair of recessed portions each provided on each of said elongated bars; a pair of spring-biased raised portions each provided on an end of the bezel body; at least one fastening device being substantially a rectangular body comprising a through opening for mounting on each of said tubes; and at least one elastic driving device secured by the fastening device on each of said tubes, the elastic driving device being substantially a rectangular body having a cavity for receiving an elastic means and a slidable block seated on the elastic means; wherein the slidable block has a protruded portion having a width corresponding to a width of an elongated slot formed on a side of each said bars for being slidingly received therein such that when the extendable handle is pressed to a retracted position, each spring-biased raised portion is protruded into each corresponding recessed portion of said elongated bars for locking the extendable handle, while the protruded portion is slid downwardly along the slot to thereby compress the elastic means and thus move the slidable block to a lowest position in the elastic driving device; and when each spring-biased raised portion is retracted into the bezel body by pressing the button, the extendable handle is unlocked and popup immediately such that the protruded portion is slid upwardly along the slot by the expanding force of the elastic means and thus move the slidable block to a highest position in the elastic driving device.

In accordance with the invention, the assembly and disassembly of the component parts of the pop-up mechanism of the invention can be easily carried out than those in the prior art, resulting in a reduction in the manufacturing and maintenance costs.

BRIEF DESCRIPTION Of DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
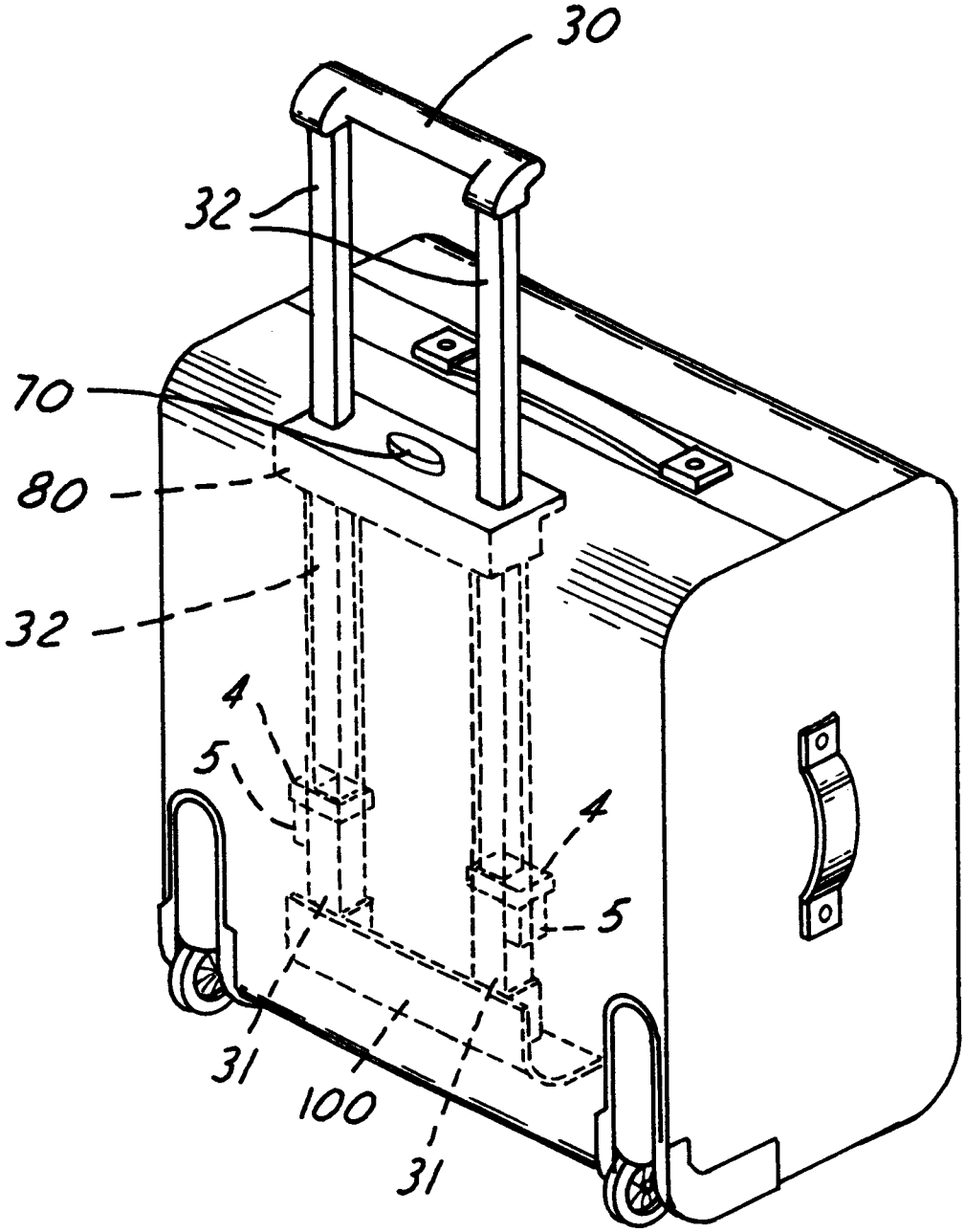
FIG. 1 is a schematic perspective view of a wheeled luggage case which is provided with the pop-up mechanism of the invention for its extendable handle.

FIG. 1 is a schematic perspective view of a wheeled luggage case which has an extendable handle provided with the pop-up mechanism of the invention. As shown, the wheeled luggage case includes an extendable handle which includes a handle 30 and a pair of elongated bars 32 which can be retracted into a pair of tubes 31 respectively. When the elongated bars 32 are fully retracted into the tubes 31, the handle 30 is rested on a bezel body 80. The user can unlock and pop up the extendable handle by pressing a button 70 provided on the top of the bezel body 80. The tubes 31 are mounted on a base support 100 provided on the bottom side of the luggage case. These component parts are substantially identical with those in the prior art.

The wheeled luggage case features the provision of the pop-up mechanism of the invention to allow the user to conveniently pull the extendable handle from the retracted and locked position so that the extendable handle can be easily extended for use. The pop-up mechanism includes a pair of fastening devices 4 and a pair of elastic driving devices 5. Each elastic driving device 5 is fastened by one fastening device 4 on one of the tubes 31.

Figure 2:
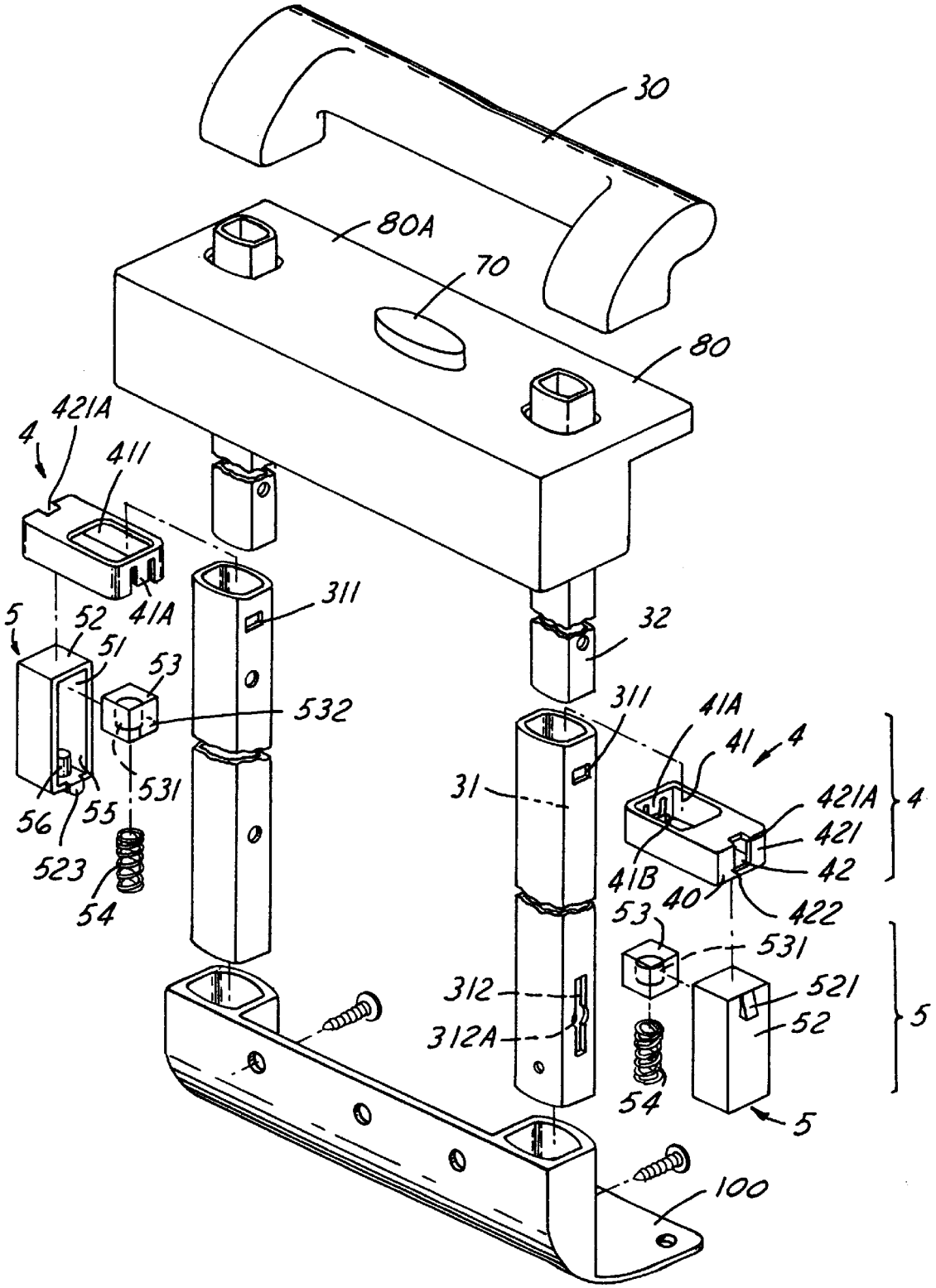
FIG. 2 is an exploded perspective view of the pop-up mechanism of the invention and the extendable handle on which the invention is provided.

Referring to FIG. 2, the fastening device 4 includes a main body 40 which is substantially a rectangular body formed with a first securing structure 41 on one side and a second securing structure 42 on the other. The main body 40 is formed with a square through opening 411 that allows the main body 40 to be sleeved on each tube 31. The first securing structure 41 allows the fastening device 4 to be secured in a position on the tubes 31 by securing the first securing structure 41 to an opening 311 in the outer wall of the tubes 31. The first securing structure 41 includes an elastic extension member 41A extended downwardly from the top of the sidewall of the square through opening 411, and a locking protrusion 41B is formed on the lower portion of said elastic extension member 41A. The second securing structure 42 includes a slot 421 formed in the inner wall on the inside of the main body 40. The top end of the slot 421 is formed with an opening 421A which extends through the top wall of the main body 40, and the bottom end of the slot 421 is formed with a hook-like structure 422. The second securing structure 42 is used to secure the elastic driving device 5 to the fastening device 4, which will be detailed later in this specification.

The elastic driving device 5 includes a rectangular main body 52 formed with a cavity 51 for accommodating a slidable block 53 and an elastic member, such as a spring 54. The spring 54 has one end inserted into a circular recess 531 formed on the bottom side of the slidable block 53 and the other end sleeved on a pin 56 formed on the inner wall in the cavity 51 of the main body 52. The spring 54 will be compressed when the slidable block 53 moves downwardly. When the elastic driving device 5 is mounted on the tube 31, the open side 55 of the cavity 51 faces towards the tube 31. The main body 52 of the elastic driving device 5 is formed with an integrally formed elastic bent piece 521 which can be hooked to the hook-like structure 422 in the main body 40 of the fastening device 4 so as to secure the elastic driving device 5 to the fastening device 4. When disassembled, the elastic driving device 5 can be separated from the fastening device 4 by simply using a screwdriver with a flat tip to insert into the opening 421A on the top end of the slot 421 to cause the bent piece 521 separated from the hook-like structure 422.

Further, the slidable block 53 is formed with an urging piece 532, and correspondingly, the tube 31 is formed with an elongated slot 312 which allows the urging piece 532, to be slidable therealong. A securing piece 523 is formed at the bottom end of the main body 52, which allows the main body 52 to be securely fastened to the tube 31 by securing the securing piece 523 to the bottom end of the elongated slot 312. Further, the elongated slot 312 is formed with a wide opening 312A in the middle which allows the securing piece 523 on the main body 52 to pass therethrough such that the securing piece 523 is secured in the cavity of the tube 31 and abutted on the bottom end of each elongated bar 32 of the handle 30.

The operation of the pop-up mechanism of the invention is described in the following with reference to FIGS. 3 and 4.

Figure 3:
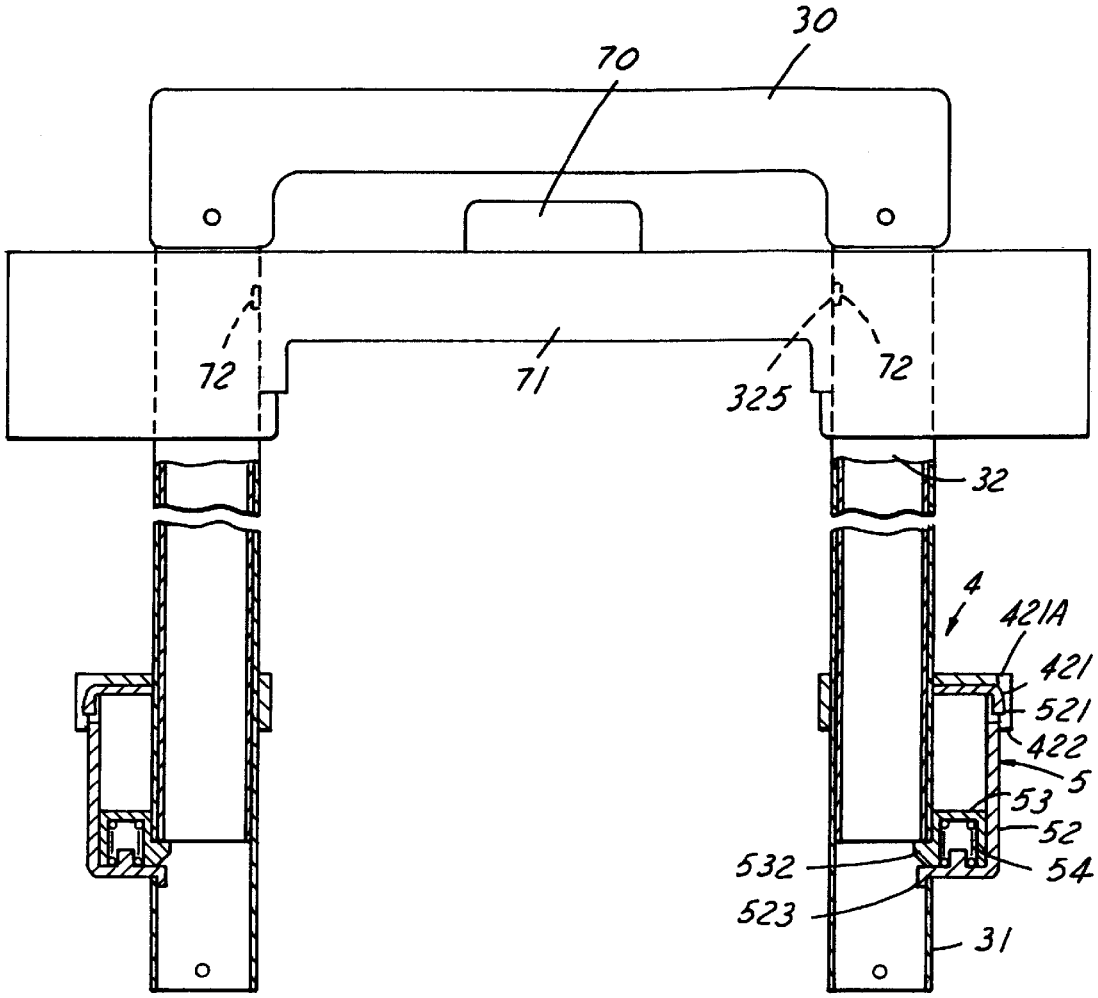
FIG. 3 is a schematic side view of the pop-up mechanism of the invention when the extendable handle is retracted.

FIG. 3 is a schematic side view of the pop-up mechanism of the invention when the extendable handle is in a retracted position. As shown, when in a retracted position, the elongated bars 32 of the handle 30 are retracted into the tubes 31, causing the bottom of the tubes 31 to be urged against the urging piece 532 on the slidable block 53 such that the slidable block 53 is moved to a lowest position in the main body 52 of the elastic driving device 5, thus compressing the spring 54. In this condition, the upper stopper 325 on the elongated bar 32 is stopped by a pin 72 formed on the supporting body 71 so that the elongated bars 32 can be maintained in the retracted position.

Figure 4:
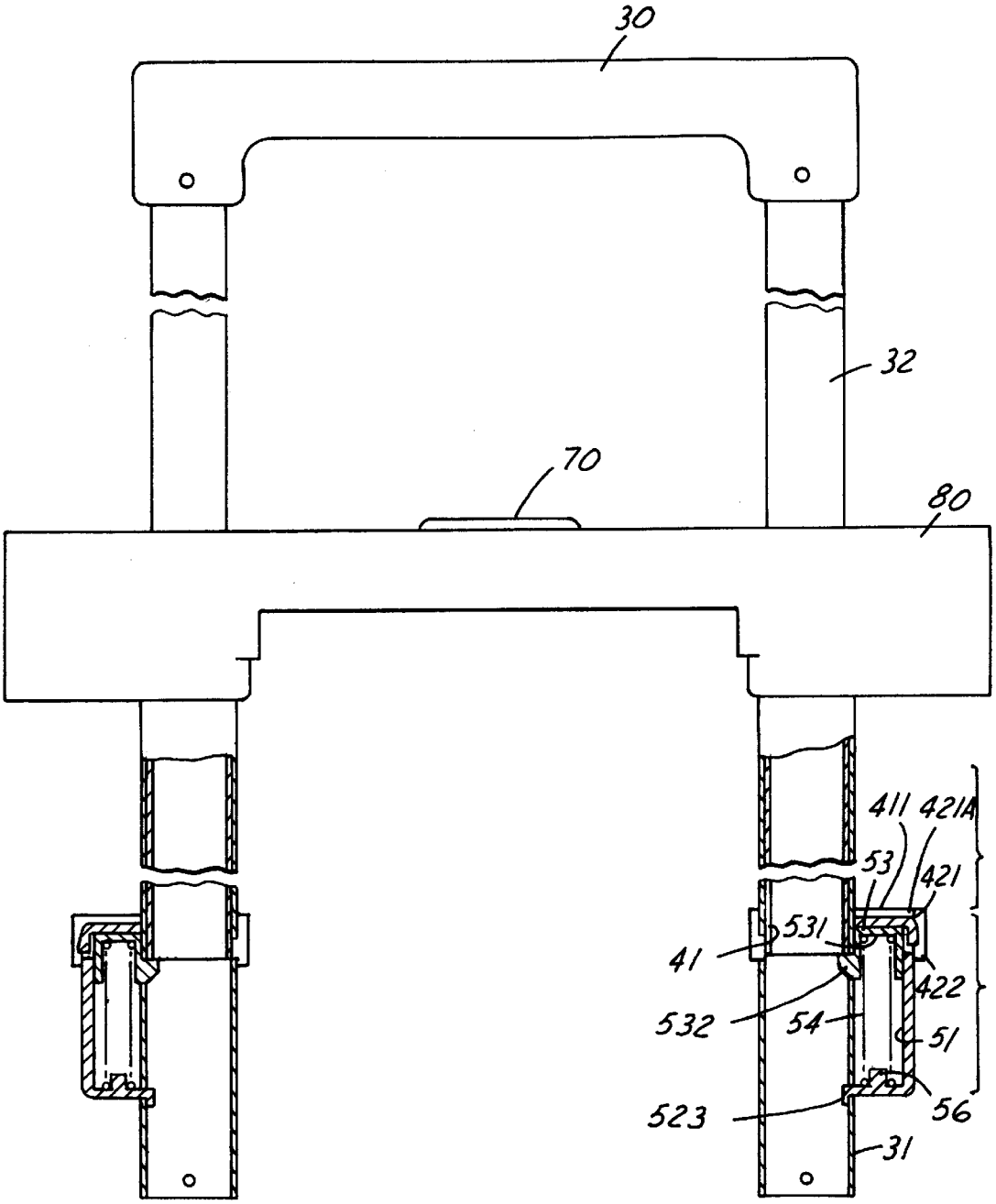
FIG. 4 is a schematic side view of the pop-up mechanism of the invention when the extendable handle is popped up.

Further, as shown in FIG. 4, when the user presses on the button 70, the upper stopper 325 is unconstrained by the pin 72. Consequently, due to the elastic force of the compressed spring 54, the slidable block 53 will be pushed upwardly, thereby allowing the urging piece 532 to urge against the bottom of the elongated bars 32 and thus push them upwardly. As a result, the handle 30 is popped up and the user is allowed to conveniently grip the handle 30 to pull the luggage case on the ground.

It is apparent from the foregoing description that in accordance with the invention, the assembly and disassembly of the component parts of the pop-up mechanism of the invention can be easily carried out than those in the prior art, resulting in a reduction in the manufacturing and maintenance costs.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A pop-up mechanism for an extendable handle on a wheeled luggage case, the extendable handle including a pair of parallelly elongated bars which are extendable from and retracted into a pair of tubes on the luggage case, comprising:

a bezel body having a button;

a pair of recessed portions each provided on each of said elongated bars;

a pair of spring-biased raised portions each provided on an end of the bezel body;

at least one fastening device being substantially a rectangular body comprising a through opening for mounting on each of said tubes; and at least one elastic driving device secured by the fastening device on each of said tubes, the elastic driving device being substantially a rectangular body having a cavity receiving an elastic means and a slidable block seated on the elastic means;

wherein the slidable block has a protruded portion having a width corresponding to a width of an elongated slot formed on a side of each said tubes for being slidingly received therein such that when the extendable handle is pressed to a retracted position, each spring-biased raised portion is protruded into each corresponding recessed portion of said elongated bars for locking the extendable handle, while the protruded portion is slid downwardly along the slot to thereby compress the elastic means and thus move the slidable block to a lowest position in the elastic driving device; and when each spring-biased raised portion is retracted into the bezel body by pressing the button, the extendable handle is unlocked and pop-up immediately such that the protruded portion is slid upwardly along the slot by the expanding force of the elastic means and thus move the slidable block to a highest position in the elastic driving device.

2. The pop-up mechanism of claim 1, wherein the fastening device comprises a first securing structure which is secured to an opening formed in an outer wall of each of said tubes so as to secure the fastening device in a position on the tube, and a second securing structure which is secured to a bent piece formed on the elastic driving device so as to secure the fastening device to the elastic driving device.

3. The pop-up mechanism of claim 2, wherein the second securing structure includes a slot formed in an inner wall on an inner side of the rectangular body of the fastening device, an opening formed on a top end of the slot, and a hook-like structure formed on a bottom end of the slot which can be secured to the bent piece on the elastic driving device.

4. The pop-up mechanism of claim 2, wherein the tube is formed with an opening which allows the fastening device to be secured to the tube by engaging the first securing structure of the fastening device with the opening.

5. The pop-up mechanism of claim 1, wherein the slidable block is provided with a recess and the rectangular body of the elastic driving device is provided with a pin so as to receive one end of the elastic means within the recess and insert the other end of the elastic means onto the pin.

6. The pop-up mechanism of claim 1, wherein a bottom of the rectangular body of the elastic driving device is provided with a protruded piece which can be insert into a bottom end of the elongated slot so as to secure the elastic driving device to the tube.

* * * * *